United States Patent [19]

Fejmert

[11] 4,403,865

[45] Sep. 13, 1983

[54] DEVICE IN CONNECTION WITH MIXING APPARATUSES

[76] Inventor: Bernhard V. Fejmert, Nordostpassagen 19, S-413 11 Göteborg, Sweden

[21] Appl. No.: 233,609

[22] PCT Filed: Jun. 18, 1979

[86] PCT No.: PCT/SE79/00138

§ 371 Date: Feb. 4, 1981

§ 102(e) Date: Feb. 4, 1981

[87] PCT Pub. No.: WO80/02808

PCT Pub. Date: Dec. 24, 1980

[30] Foreign Application Priority Data

Dec. 19, 1977 [SE] Sweden ..... 77/14394

[51] Int. Cl.[3] ..... B28C 5/20

[52] U.S. Cl. ..... 366/44; 366/57; 366/228

[58] Field of Search ..... 366/44, 135, 55, 56, 366/57, 58, 59, 187, 225, 228, 230, 233

[56] References Cited

U.S. PATENT DOCUMENTS

| | | | |
|---|---|---|---|
| 971,051 | 9/1910 | Larkin, Jr. | 366/57 |
| 1,220,683 | 3/1917 | Ransome | 366/57 |
| 2,305,272 | 12/1942 | Petersen | 366/229 |
| 2,614,819 | 10/1952 | Longenecker | 366/59 |
| 2,708,570 | 5/1955 | Manabe | 366/57 |
| 3,552,721 | 1/1971 | Phillips | 366/135 |
| 3,915,439 | 10/1975 | Albin et al. | 366/44 |

FOREIGN PATENT DOCUMENTS 497319 5/1930 Fed. Rep. of Germany .

*Primary Examiner*—Philip R. Coe
*Assistant Examiner*—Joseph M. Pitko

[57] ABSTRACT

A mixing apparatus having a rotatable drum with a horizontal axis of rotation and an input and a discharge end. The drum supports a number of first mixing wings which upon rotation of the drum in the mixing direction convey the material to be mixed towards the input end and upon rotation in the opposite direction towards the discharge end. There are also a number of second mixing wings having a V-shaped cross-section forming a chute-shaped first side directed towards the discharge end and a roof-like second side. The second mixing wings are attached to the first wings in such a position that the chute-shaped first sides are below the first wings to carry material falling off the first wings towards the input end when the drum rotates in the mixing direction, and so that the roof-like second sides are below the first wings as a consequence of the rotation of the drum in the discharge direction so that the material falling down on the second sides leaves the second wings sideways.

6 Claims, 5 Drawing Figures

DEVICE IN CONNECTION WITH MIXING APPARATUSES

TECHNICAL FIELD

The present invention relates to mixing apparatus, such as concrete mixers, which have a rotatable drum with substantially horizontal axis of rotation and with one end, which is provided for the inut of the material that shall be mixed, and one end which is provided for the discharge of the mixed material, and with a shell, which supports a number of mixing wings, which have a screwlike arrangement. Thus, during the rotation of the drum in one direction, the mixing direction, they tend to convey the material in axial direction towards the input end and during the rotation in the opposite direction, the discharge direction, they will feed the material in axial direction towards the discharge end. The shell also supports additional mixing wings, of which each one is attached in such a position relative to one of the first mixing wings that the additional wing is below the belonging first wing, when this wing as a consequence of the rotation of the drum in the mixing direction is in an angular position, which means that the material carried along by the wing slides off the same, so that this material then hits the belonging outer wing, which has such a screw-form that because of its inclination it tends to convey the material in direction towards the discharge end. In this way, the material gets a double directed axial movement for one thing in a layer in the direction towards the input end by the action of the first wings, and for another thing in a layer in the direction towards the discharge end as a result of the action of the additional wings.

The invention especially relates to free-fall mixers with a horizontal mixing drum and discharge wings.

BACKGROUND

When mixing concrete, three principal ingredients shall be mixed: Cement, aggregate and water. In order to carry out this mixing operation, extensive use has been made of free-fall mixing machinery. A mixer of the type considered here has a horizontal mixing drum with two series of wings, viz. mixing wings and discharging wings. The drum is charged at one end, and the material then meets the mixing wings, which move the material in upwards direction and again lets it fall down, whereby the ingredients of the mass are mixed together. During this operation the wings are adjusted in such a way that the material is kept back at the input end of the drum. When the drum shall be emptied, its direction of rotation is reversed. The mixing wings then feed the material in a direction away from the input end towards the other end of the drum, when the material is discharged by means of the helicoidal setting of the discharge wings. Thus the horizontal position of the drum is maintained during the charging, mixing and emptying operations.

TECHNICAL PROBLEM

This type of mixer has turned out to produce an acceptable result, as long as the mixing operation only comprises the three principal ingredients. However, in modern concrete technology additional ingredients are used, their proportion relative to the total mix being very small. Carefully carried out experiments have proved that the type of mixer mentioned cannot produce a uniform distribution of said ingredients in the bulk of the mixture. By way of example ingredients can be mentioned, which are utilized in order to render the concrete pumpable. One such ingredient producing air bubbles has the trade name of Sika AER and shall be admixed in a quantity of the order of 0.5 kg per $m^3$ of concrete mass, which illustrates the difficulties in obtaining a uniform distribution. If an ingredient of this kind is not admixed with a great uniformity in the mass, certain portions of the charge will get such poor pumping properties that a jamming of the pumps used for the transportation of the mass is risked. An improved mixture can be obtained by prolonging the time of the mixing operation, which, however, is not efficient and in addition results in that the deposits of hardened concrete in the mixer will increase.

It is an object of the present invention to provide a concrete mixer of the free-fall type, which, while maintaining a short processing time, makes possible such a thorough mixture of the materials entering into the concrete mass that also ingredients in very small relative quantities will get a substantially uniform distribution in the mixture.

It is another object of the invention to provide a concrete mixer in which the mass to be mixed gets a very uniform distribution in the longitudinal direction of the mixing drum, whereby a skewing of the load operation on the drum is avoided.

The invention has been made with the intention to solve said problems in connection with the mixture of concrete, but the invention is also applicable to mixing apparatuses in other fields, where a thorough mixture of several ingredients in widely varying proportions is required.

THE SOLUTION

The object of the present invention is obtained by a device which is charaterized by the additional wings being designed with a preferably chute-shaped side, which is directed towards the frontrunning first wing and permits that the material falling down on the wing is conveyed in its longitudinal direction, while the wing is inclined, and an opposite side with surfaces inclining outwards their edges and arranged to permit the material falling down on this side to sidewise leave the wing in a movement that is transversal to the wing. Thus, the transportation by means of the additional wing takes place in axial direction in connection with a rotation in substantially the mixing direction only, and the movement of the material in the discharge direction during a corresponding rotation by action of the first wings which preferably are supplemented by action of special wings at the discharge end, is substantially unaffected by the additional wings.

BRIEF DESCRIPTION OF DRAWINGS

The invention is described in the following, reference being made to the accompanying drawings, in which.

BEST MODE OF CARRYING OUT THE INVENTION

Figure 1:
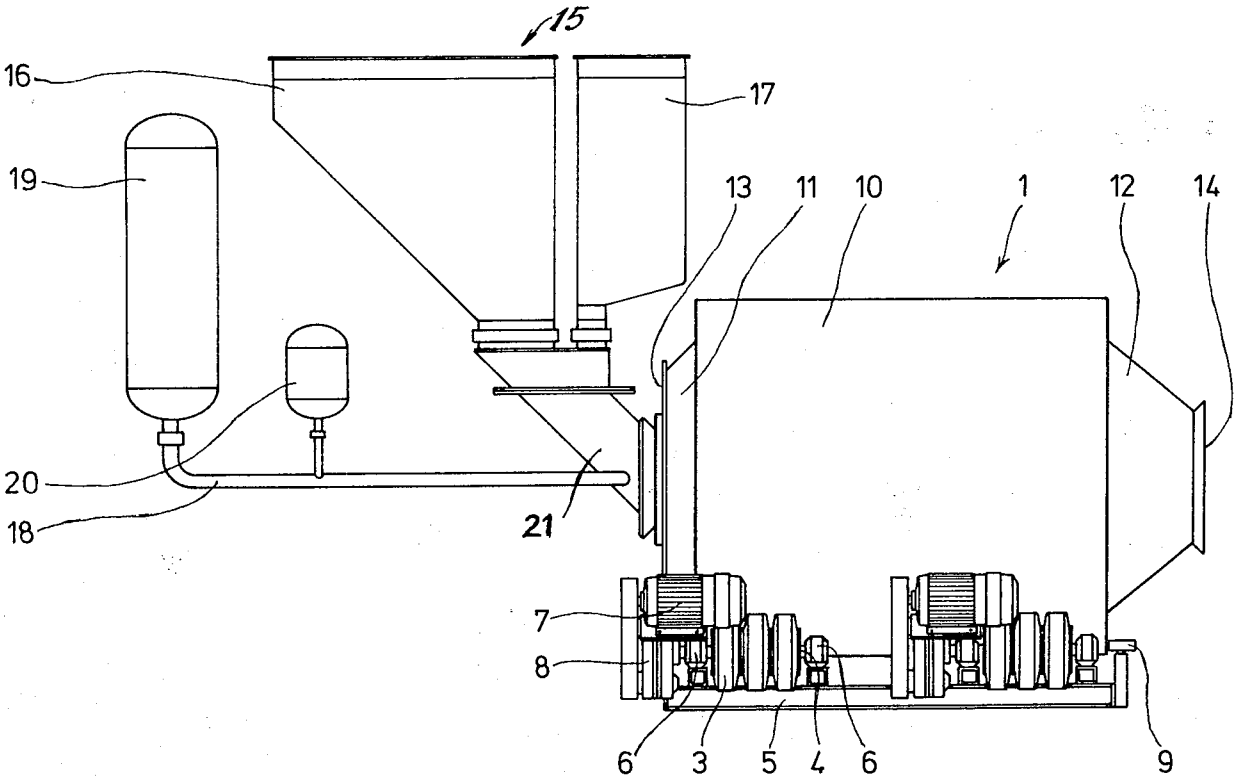
FIG. 1 is a side elevational view of a mixer according to the invention.

As to its exterior the concrete mixer according to the example of embodiment illustrated substantially corresponds to a conventional concrete mixer of the free-fall type. Such a mixer has a mixing drum 1, which at its ends is supported by rollers 4 with driving rings 3. The rollers 4, of which only two are illustrated in FIG. 1, are four in number and are journalled in a frame 5 with bearings 6. Both the illustrated rollers are arranged to be driven by motors 7 via power transmissions 8. Rollers 9 are provided at each end for axial control.

The mixing drum has a shell with a cylindrical portion 10, a first conical portion 11, and a second conical portion 12. In the first conical portion 11 there is an input opening 13, and in the other conical portion 12 there is discharge opening 14 (see FIGS. 4 and 5). In the following description the one end of the mixing drum 1, which has the first conical portion 11, and the input opening 13, is called the input end 11, 13, and the end, which has the shell portion 12 and the discharge opening 14, is called the discharge end 12, 14. A charging device 15 is provided at the input end 11, 13 and comprises a filling hopper 16 for aggregate, a filling hopper 17 for cement, a filling pipe 18 for water, which extends from a water tank 19, and one or several receptacles 20 for such additives, which shall be present in small relative quantities. The receptacle or receptacles 20 empty into the pipe 18, which in its turn empties into a feeding drum 21, to which also the feeding hoppers 16, 17 are connected. The feeding drum 21 is connected with the input opening 13, through which the material can be introduced into the drum 1.

Figure 3:
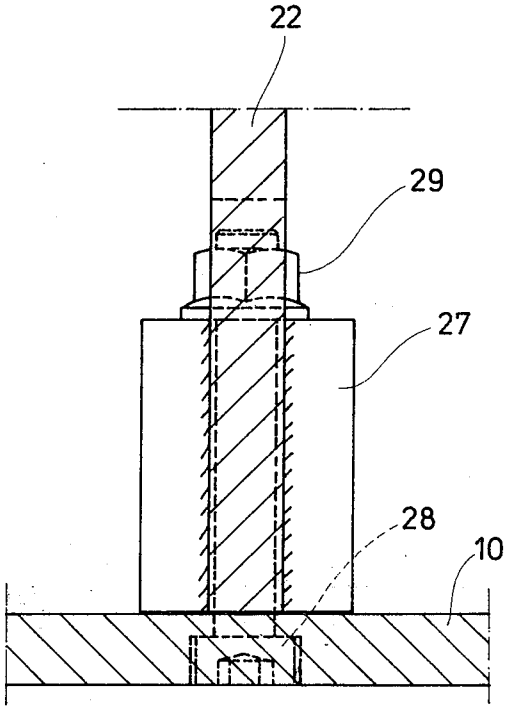
FIG. 3 in a cross-sectional view along the line III—III in FIG. 2, illustrate a fastening arrangement of a mixing wing.
Figure 2:
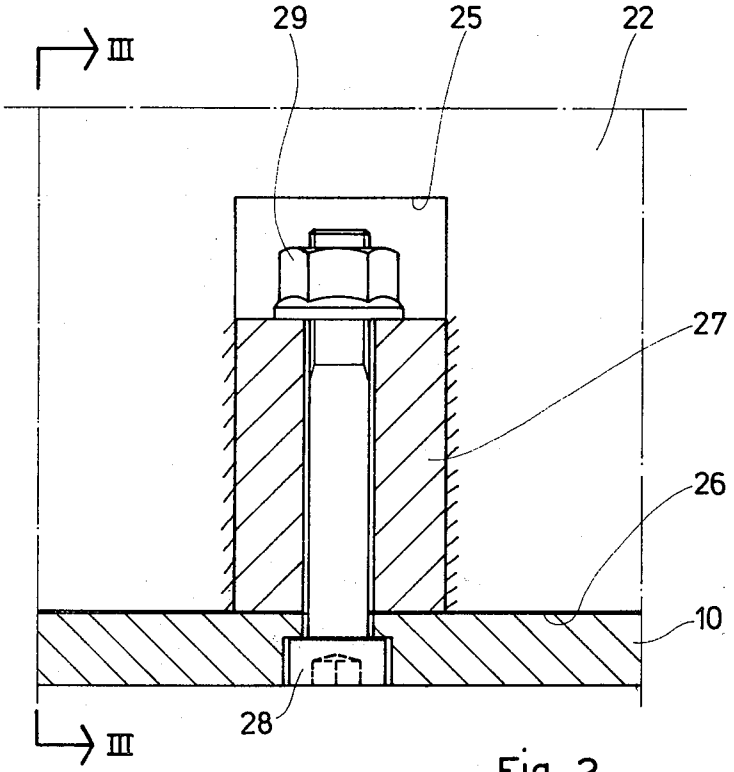
FIG. 2 a partial cross-sectional view.
Figure 4:
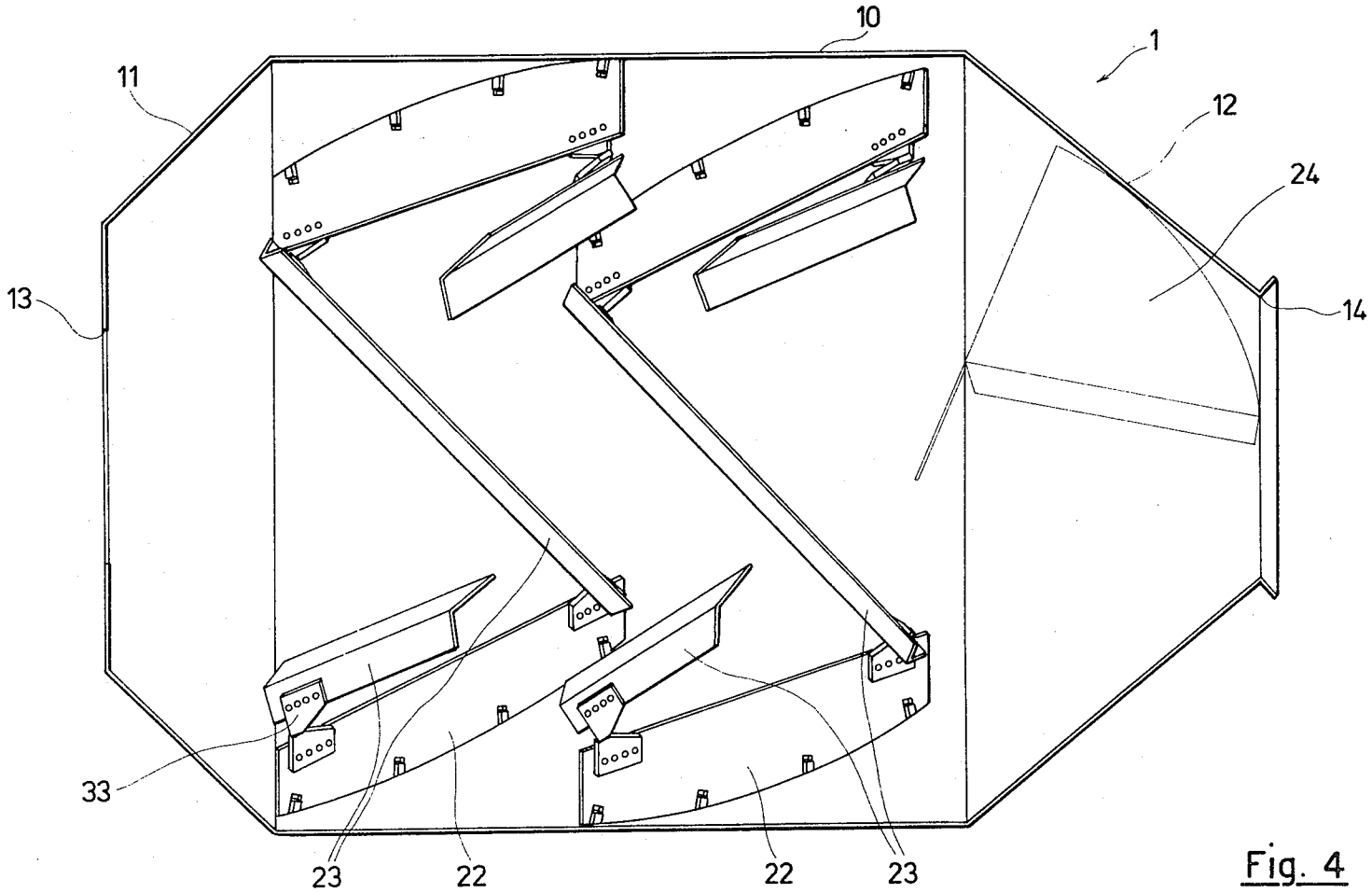
FIG. 4 is a longitudinal cross-sectional view through a mixing drum.
Figure 5:
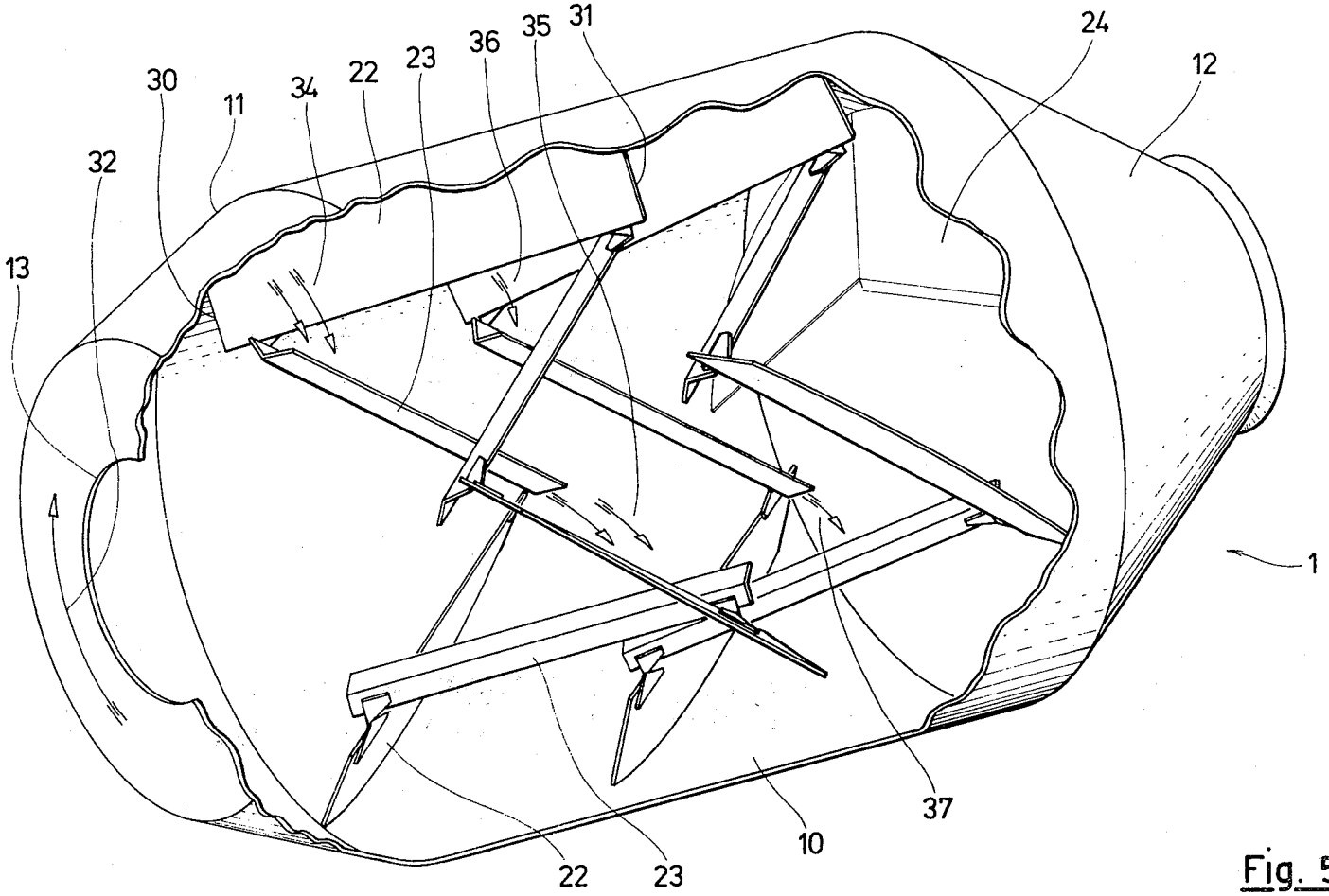
FIG. 5 is a perspective view of the drum in partly cut-up condition.

The general design of the mixing machine has now been described, and the following description therefore substantially refers to the wingsystem housed in the mixing drum 1, the main features of which are illustrated in FIGS. 4 and 5. The wing system comprises three series of wings, viz. outer mixing wings 22, inner mixing wings 23, and discharge wings 24. The mixing wings 22 are placed on the inside of the cylindrical portion 10 and distributed on two holder devices located one after the other in axial direction. The discharge wings 24 are placed on the inside of the second conical portion 12. The outer mixing wings 22 and the discharge wings 24 have an oblique mounting and can be considered to form parts of a thread with several entries, the thread direction being common for the wings 22 and 24. All of the wings 22 and 24 comprise sheet metal blades with an inner edge, which with respect to inner surfaces of the portions 10 and 12 respectively and the oblique mounting of the wings, has such a curved shape that said outer edge obtains a good contact with the wall of the drum 1. The free edges of the wings are substantially adapted to the conditions of manufacture and according to the drawings have straight lines. The design of the discharge wings is not a characteristic feature of the invention, but corresponds to what is used in the prior art. Also the outer mixing wings as to their main features correspond to what have hitherto been common features of the design of free-fall mixers. The mounting of the wings 22 and 24 is in detail evident from FIGS. 2 and 3. Thus the wing 22 is provided with a rectangular opening 25 departing from the edge 26 of the wing facing the shell portion 10. A sleeve 27 with a through hole is welded into this opening. A screw 28 with a nut 29, which is located in a free portion of the opening 25, located inside the inner end of the sleeve 27, extends through a corresponding hole in the wall of the shell 10. Thus, the wings are attached by means of a number of screws 28 being led through the wall of the shell and into the sleeves 27 of the wing and being tightened by means of a corresponding number of the nuts 29. The discharge wings 24 are mounted in a corresponding manner. The drum in mixers of this type is often lined with a wear resistant rubber, which then covers the means of attachment.

The inner mixing wings 23 extend between the corners of the outer mixing wings 22. The inner mixing wings 23 haave a V-shaped profile.

The location of the inner mixing wings can be described in the following manner: The outer mixing wings 22 can be considered to have a rear edge 30 and a forward edge 31, if one takes into consideration the direction of feed through the drum 1, viz. from the input end 11, 13 towards the discharge end 12, 14. The forward edge 31 is at the same time because of the oblique mounting of the wings the front-running edge, when the drum performs its rotation in the mixing direction indicated by an arrow 32 in FIG. 5. In the example of embodiment shown each holder device has three outer mixing wings 22, the angular distance between them consequently being 120°. The inner mixing wings 23 extend between the rear succeeding edge 30 of one of the outer mixing wings 22 and the forward front-running edge 31 of the outer mixing wing 22, which is the wing that follows in the direction of rotation, when the mixing is going on (see arrow 32). This, thus, means that each inner mixing wing 23 extends from the rear succeeding corner of an outer mixing wing and forwards in the direction of feed and backwards in the direction of rotation to the front corner of next outer mixing wing 22. The concave sides of the inner mixing wings 23 are directed towards the front-running wing and the convex side towards a succeeding wing of the outer mixing wings, which it connects. In each holder device of the outer mixing wings 22 the wings in between them are connected by means of a separate holder device of three inner mixing wings 23, whereby also the inner mixing wings form two holder device sets. The connection between the outer and the inner mixing wings according to the example of embodiment takes place by means of a fastening means 33 comprising two plates, which in between them are distorted, and which give the correct angle between the two wings, said plates being attached to the respective wings by means of rivets or screws. The inner mixing wings, thus, do not have any direct attachment to the mixing drum 1.

Besides the parts, which have been described in connection with the mixing machine according to the invention, said machine can comprise additional features, such as the inner lining of the mixing drum with wear resistant rubber, a dosing equipment at the input, some form of collecting means at the output etc. However, such details and such equipment are of earlier known kinds and have no direct significance for the invention, because of which they are left out of the description.

When producing a charge of mixing mass, the different ingredients after dosage are made to fall down from the input means 15 into the drum 1. When mixing concrete, this means that aggregate is supplied through the hopper 16, cement through the hopper 17, water and one or several ingredients in small quantities from the tank or receptacles 20 through the pipe 18. The ingredients are introduced into the mixing drum 1 through the input opening 13 and thus land up close to the input end at the shell portion 11. When the drum is rotating in the direction of the arrow 32, which is the case during a mixing operation, the ingredients will be mixed together with each other by means of the cooperation between the mixing wings 22 and 23. During this phase the mixing mass remains within the area of the shell portion 10, and the mass, which possibly finds its way towards the shell portion 12, will be fed back by the discharge wings 24, which operate as a screw in direction towards the shell portion 10. When after a predetermined time interval the mixing process is calculated to be finished, the rotation of the drum 1 is reversed. The outer mixing wings 22 will then feed the mass in forwards direction to the shell portion 12, where it is caught by the discharge wings 24, which during this direction of rotation in a screwlike manner feed the mass in forwards direction to the output opening 14 and out through this opening. The drum is thereby emptied of the ready prepared mixture for its subsequent transportation to the place, where it shall be used. The drum is now ready for a new mixing cycle.

The mixing wings during the mixing operation work in the following manner: It can be assumed that the ingredients, when filled through the opening 13, will land up in the section 10 immediately inside of the section 11, and thus, during the rotation of the drum 1 be carried along the outer mixing wings 22 in a direction which as seen in FIGS. 4, 5 points upwards/away (see the arrow 32). When during this phase the material has been lifted up for a certain angle, which can be assumed to amount to 120° from the bottom position, it will slide down along the wing 22 to the rear succeeding corner of the same, and from there it will fall down, the bulk of the material landing up in the inner mixing wing 23, which connects to the corners of the wing 22 (see the arrow 34), which then has its chute-like side facing upwards. During a continued rotation this inclination of the wing will increase. Contrary to the inclination of the wing 22, which at the sliding down occasion was in backwards direction (towards the input end 11, 13) the inner wing 23 has a forwards inclination, and thus, the material will slide forwards and is then thrown outside the end of the wing (see the arrow 35) and lands up in front of one of the outer mixing wings 22 of the holding device. When this wing in its turn is lifted during the continued rotation, the material will slide down from the wing into the inner mixing wing 23 (see the arrow 36), which is connected with its rear corner. The material now slides along this wing, and when it leaves the same (see the arrow 37) it lands up farthest to the front of the section 10 immediately close to the discharge wings 24, past which the material cannot proceed because of the backwards directed feeding action of the same. From this position the material will again be moved in upwards direction by the succceeding outer mixing wing 22, and the cycle will be repeated. When the material leaves any of the outer mixing wings of the second holding device, it can be assumed that a certain portion of the material does not land in the inner mixing wing 23 belonging to said holder device, but continues landing in front of one of the outer mixing wings 22 of the first holder device. During the continued rotation this portion of the material will slide down from this wing and fall into the inner mixing wing belonging to this first holder device and continue its cycle as has previously been described. Material, which possibly may leave the mixing wings of the first holder device in the direction towards the input opening, will be returned to the area in front of the wings because of the inclination of the conical section 11.

As has been evident from the preceding description the mixing mass thus will carry out a cyclic course, where the axial feeding movement of the mixing mass in an outer ring represented by the outer mixing wings 22 is in direction towards the input end 11, 13, and where the axial direction of feed in an inner ringshaped volume represented by the inner mixing wings 23 is in opposite direction towards the output end 12, 14. By this arrangement the particles of the mass will continuously change position relative to each other in radial direction because of their rising and falling movements as well as in axial direction because of the sliding movement performed in both axial directions along the wings. This is in contrast to mixers of conventional design, in which the mixing operation substantially takes place in radial direction only, whereby material, which from an axial viewpoint has landed within a limited zone at the input, is not uniformly distributed, but will be admixed to the mass in said zone only. Because of the two axially opposite movements the mass in the mixer according to the invention will be substantially uniformly distributed along the section 10, which results in advantageous conditions of load operating on the driving mechanism and in a uniform wear of the rollers 3. On the other hand the mixing wings in conventional mixers all the time tend to force the mass towards the input end, so that the load will be concentrated here with an unequal wear of the driving mechanism as a consequence.

During the discharge operation the movement of the drum 1 is as mentioned reversed. Then the oblique outer mixing wings 22 will thereby act in opposite direction, so that the material that is lifted up will slide down along the wings and leave them in the direction towards the discharge end 12, 14. Material that leaves the wings of the first holder device is then taken care of by the wings of the second holder device and finally lands in front of the discharge wings 24, which because of their screw feed convey the material out through the discharge opening 14. When the material slides down from the wings 22, it cannot be avoided that part of it meets the inner wings 23. The wings in question therefore have an inclination in direction towards the input end 11, 13, a fact which could result in that a certain portion of the material would be returned to the input end, so that the discharge would be incomplete or in any case would take an unnecessarily long time. In the mixing machine according to the invention, however, this effect is avoided because of the angular profile of the wings. As long as they work in the mixing direction, they serve the purpose of chutes, which convey the material hitting the wings in the intended mixing direction without any lateral spillage. On the other hand when the rotation takes place in the discharge direction, the material hits the ridge side of the wings, for which the angles are determined in such a manner that the angle of lateral down-slide is greater than the one in the longitudinal direction, whereby the material is not axially transported but falls straight down and is consequently taken care of by the outer wings 22 in order to be fed towards the discharge opening. By this arrangement an unfavourable influence by the inner wings on the discharge operation is avoided.

I claim:

1. A mixing apparatus having a rotatable drum with an essentially horizontal axis of rotation and having an input end for the input of material to be mixed, and a discharge end for the discharge of the mixed material, and with a shell which supports a plurality of first mixing wings in a screw-like arrangement, so that during rotation of the drum in a first direction, the mixing direction, said mixing wings convey the material in axial direction towards the input end and during the rotation in a second, opposite direction, the discharge direction, said mixing wings feed the material in axial direction towards the discharge end, and a plurality of second mixing wings having a V-shaped cross section so as to form a chute-shaped first side which is directed towards said discharge end, and a roof-like second side, said plurality of second mixing wings being respectively attached to said plurality of first wings in such a position that the chute-shaped first sides of said second wings are below the first wings when said second wings as a consequence of rotation of the drum in said first direction are in an angular position so that material carried along by said first wings slides off the same and hits the chute-shaped first side of the second wings therebelow, said second wings having such a screw-form that because of their inclination they convey the material in a direction towards the discharge end whereby the material gets a double directed axial movement, one in a direction towards the input end by the action of the first wings and one in a direction towards the discharge end as a result of the action of the second wings, said second wings also being respectively attached to said first wings in such a position that the roof-like second sides of said second wings are below the first wings so that as a consequence of rotation of the drum in the second direction the material falling down on the roof-like second side from the first wings leaves the second wings in a movement that is transversal to the second wings, so that the transportation by means of the second wing takes place in axial direction in connection with a rotation in substantially the mixing direction only, and the movement of the material in the discharge direction during a corresponding rotation by action of the first wings is substantially unaffected by the second wings.

2. An apparatus according to claim 1, wherein each of the second wings extends over a certain angle between two of the first mixing wings from a point nearest to the input end in the mixing direction to the end of a succeeding first wing directed towards the discharge end.

3. An apparatus according to claim 1 or 2, wherein said first mixing wings are arranged in several holding devices axially following one another, said second mixing wings being arranged to feed the material from the holding device nearest the input end in direction to the discharge end to the next following holding device.

4. An apparatus according to claim 1, wherein said first wings are attached to the wall of the drum and have bodies with holes substantially perpendicular to the wall and arranged to receive screws extending through the wall for the fastening of the wings.

5. An apparatus according to claim 4, wherein the edges of the wings have recesses, in each one of which one of said bodies is mounted in such a manner that its hole is right in front of the edges of the wing surrounding the recess.

6. An apparatus according to claim 5, wherein the recess extends further inwards in the wing than the corresponding body, which has a through hole for the screw, whereby a space for the end of the screw and a nut at the inside of the body is formed.

* * * * *